US006753837B2

(12) United States Patent
Ham

(10) Patent No.: US 6,753,837 B2
(45) Date of Patent: Jun. 22, 2004

(54) METHOD AND APPARATUS FOR DRIVING LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 225 days.

(21) Appl. No.: 10/015,664

(22) Filed: Dec. 17, 2001

(65) Prior Publication Data

US 2003/0052845 A1 Mar. 20, 2003

(30) Foreign Application Priority Data

Sep. 4, 2001 (KR) ..... P2001-54123

(51) Int. Cl.[7] ..... G09G 3/18
(52) U.S. Cl. ..... 345/88; 345/92; 345/204
(58) Field of Search ..... 345/600, 87–103, 345/204, 205, 208, 209, 210

(56) References Cited

U.S. PATENT DOCUMENTS 5,495,265 A 2/1996 Hartman et al. ..... 345/87
5,956,006 A * 9/1999 Sato ..... 345/88
6,333,727 B2 * 12/2001 Mizumaki ..... 345/89
6,501,451 B1 * 12/2002 Sakashita ..... 345/87
2002/0033813 A1 * 3/2002 Matsumura et al. ..... 345/204

FOREIGN PATENT DOCUMENTS

WO WO99/05567 2/1999

* cited by examiner

*Primary Examiner*—Lun-Yi Lao
(74) *Attorney, Agent, or Firm*—Morgan Lewis & Bockius LLP

(57) ABSTRACT

The present invention discloses a method and apparatus of driving a liquid crystal display device that prevents a deterioration of picture quality. More specifically, the method and apparatus determines whether the adjacent modulated data are equal to each other, and replaces least significant bit data with a desired value if the adjacent modulated data are equal to each other.

15 Claims, 7 Drawing Sheets

METHOD AND APPARATUS FOR DRIVING LIQUID CRYSTAL DISPLAY

This application claims the benefit of Korean Application No. P2001-54123 filed on Sep. 4, 2001, which is hereby incorporated by reference.

BACKGROUND OF THE INVENTION

1. Field of the Invention

The present invention relates to a liquid crystal display, and more particularly, to a method and apparatus for driving a liquid crystal display. Although the present invention is suitable for a wide scope of applications, it is particularly suitable for improving a picture quality.

2. Discussion of the Related Art

Generally, a liquid crystal display (LCD) controls a light transmittance of each liquid crystal cell in accordance with a video signal to thereby display a picture. An active matrix LCD including a switching device for each liquid crystal cell is suitable for displaying a moving picture. The active matrix LCD uses a thin film transistor (TFT) as a switching device.

The LCD has a disadvantage in that it has a slow response time due to inherent characteristics of a liquid crystal such as a viscosity and an elasticity, etc.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data using a look-up table (hereinafter, referred to as high-speed driving scheme). This high-speed driving scheme allows data to be modulated by a principle as shown in FIG. 2.

Referring to FIG. 2, a conventional high-speed driving scheme modulates input data VD and applies the modulated data MVD to the liquid crystal cell, thereby obtaining a desired brightness MBL. This high-speed driving scheme modulates input data on the basis of a difference of the data so that a desired brightness can be obtained in response to a brightness value of the input data within one frame interval. Accordingly, the LCD employing such a high-speed driving scheme compensates for a slow response time of the liquid crystal by modulating a data value in order to alleviate a motion-blurring phenomenon from a moving picture, thereby displaying a picture at desired color and brightness.

The high-speed driving scheme compares each most significant bit data MSB of the previous frame Fn−1 and the current frame Fn, and selects the modulated data corresponding from the look-up table to modulated as in FIG. 3, if there is any change between the most significant bit data MSB.

In case of limiting the most significant bits to 4 bits, the look-up table of the high-speed driving scheme is implemented as in Table 1 and Table 2.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 2 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 13 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 12 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |

TABLE 2-continued

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In Table 1 and Table 2, a furthermost left column is for a data voltage VDn−1 of the previous frame Fn−1 while an uppermost row is for a data voltage VDn of the current frame Fn. Table 1 is a look-up table information in which the most significant 4 bits (i.e., $2^0$, $2^1$, $2^2$ and $2^3$) are expressed by the decimal number format. Table 2 is a look-up table information in which weighting values (i.e., $2^4$, $2^5$, $2^6$ and $2^7$) of the most significant 4 bits are applied to 8-bit data.

Only the most significant bit data MSB are modulated in order to reduce the memory size and the look-up table upon implementation of hardware. In such a manner, the high-speed driving apparatus may be implemented, as shown in FIG. 4.

Referring to FIG. 4, a conventional high-speed driving apparatus includes a frame memory 43 connected to a most significant bit bus line 42, and a look-up table 44 connected to both the most significant bit bus line 42 and the frame memory 43.

More specifically, the frame memory 43 stores the most significant bit data MSB during one frame interval and supplies the stored data to the look-up table 44. Herein, the most significant bit data MSB are high-order 4 or 3 bits in the 8 bit data as described above.

The look-up table 44 compares the most significant bit data of the current frame Fn inputted from the most significant bit bus line 42 and the most significant bit data of the previous frame Fn−1 inputted from the frame memory 43 in Table 1 and Table 2, thereby selecting and outputting modulated data Mdata. The modulated most significant bit data Mdata are added with least significant bit data bypassed through a least significant bit bus line 41, and is then inputted into a liquid crystal display.

Nevertheless, the above high-speed driving method and apparatus still has a problem. For example, a difference between a modulated 8 bit data value and an actual input value becomes great even though there is almost no difference between gray levels, as shown in FIG. 5. In this case, actual gray level values which generally do not cause a recognizable difference to the naked eye. Nonetheless, it causes the recognizable difference in brightness to the naked eye. As a result, a picture quality is deteriorated as much.

FIG. 5 illustrates 8 bit modulated data expressed in decimal number. Each of the most significant bit data MSB is added with the least significant bit data LSB of 4 bits.

In FIG. 5, a band (X,Y) is the value calculated by adding the least significant bits of 4 bits with the most significant bit data MSB of 4 bits that are modulated, and is defined as a modulated data band divided by each most significant bit data MSB. Herein, X represents the value of the most significant bit data MSB of the previous frame Fn−1 expressed in 8 bit data, while Y represents the value of the least significant bit data LSB of the current frame Fn expressed in 8 bit data. The data shown in the shadow cell, which are the most significant bits in each band (X,Y), represent the modulated data registered at the look-up table of Table 1 and Table 2.

As described in Table 2 and FIG. 5, the value of the most significant bit data MSB is added with '0' to '15' corresponding to the value of the least significant bit data LSB of 4 bits, which is added with the most significant bit data MSB modulated at each band of the look-up table.

On the other hand, even when the most significant bit value included at each band of the look-up table is the same, each of the modulated data values from adjacent bands having the same most significant bit value shows a big difference. This is because the modulated most significant bit data MSB are added with the least significant bit data LSB in each band. For example, when a band (32, 0) and a band (32, 16) have the same most significant bit value of '0' in Table 2, the least significant bit data LSB added as in FIG. 5, '0' to '15' are added according to the value of the least significant bit data LSB thereof. Consequently, when the modulated data are changed from '32' to '15' and '32' to '16' in the look-up table, a brightness change should not be recognizable to the naked eye. Nonetheless, the brightness change between the corresponding data is recognizable to the naked eye because the modulated data are changed from '32' to '15' and '32' to '0', respectively. This happens particularly at the boundary between the adjacent bands where the modulated most significant bit value is equal, such as between a band (48,0) and a band (48,16), and a band (64,0) and a band (64,16).

SUMMARY OF THE INVENTION

Accordingly, the present invention is directed to a method and apparatus for driving liquid crystal display that substantially obviates one or more of problems due to limitations and disadvantages of the related art.

Another object of the present invention is to provide a method and apparatus for driving a liquid crystal display that improves a picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes dividing input data into most significant bit data and least significant bit data, deriving a data value from modulated data registered in advance for modulating the most significant bit data, determining whether adjacent modulated data are equal to each other, and replacing the least significant bit data with a desired value if the adjacent modulated data are equal to each other.

The method further includes maintaining the least significant bit data without a modulation if the adjacent modulated data are not equal to each other.

The method further includes adding the least significant bit data with the most significant bit data which are modulated to the modulated data to input into a liquid crystal display.

In the method, the modulating the most significant bit data includes determining modulated data in accordance with a difference in the input data between a previous frame and a current frame, matching the modulated data with respect to each band in a look-up table, and searching the band in the look-up table corresponding to the most significant bit data, thereby modulating the most significant bit data using the modulated data of the searched band.

In the method, determining whether adjacent modulated data are equal to each other includes deriving the modulated data from each modulated data of an adjacent band and a selected band corresponding to the most significant bit data, and determining whether the derived adjacent modulated data from each of the adjacent bands are equal.

In another aspect of the present invention, a driving apparatus for a liquid crystal display includes a memory delaying most significant bit data of input data inputted from an input line, a modulator modulating the most significant bit data from the input line and the delayed most significant bit data to select one modulated data among a plurality of modulated data registered in advance, a comparator determining whether the adjacent modulated data are equal to each other, and a least significant bit converter replacing the least significant bit data with a desired value if the adjacent modulated data adjacent are equal to each other.

In the driving apparatus, the least significant bit converter maintains the inputted least significant bit data if the adjacent modulated data are not equal to each other.

The driving apparatus further includes a data driver supplying the modulated data and bypassed data to the liquid crystal display, a gate driver supplying a scanning signal to the liquid crystal display, and a timing controller supplying the input data to the input line, and controlling the data driver and the gate driver.

In the driving apparatus, the most significant bit data and the least significant bit data are added and supplied to the data driver.

In the driving apparatus, the modulator includes a look-up table having the modulated data by bands in accordance with a difference in the input data between a previous frame and a current frame.

The least significant bit converter includes a first inverter inversing an output signal of the comparator, an NAND gate performing an NAND operation on an output signal of the first inverter and least significant bit data from the input line, and a second inverter inversing an output signal of the NAND gate.

In a further aspect of the present invention, a liquid crystal display panel having a plurality of data lines and gate lines and displaying images, a memory delaying most significant bit data of input data inputted from an input line, a modulator modulating the most significant bit data from the input line and the delayed most significant bit data to select one modulated data among a plurality of modulated data registered in advance, a comparator determining whether the adjacent modulated data are equal to each other, a least significant bit converter replacing the least significant bit data with a desired value if the adjacent modulated data are equal to each other, a data driver supplying the modulated data and bypassed data to the liquid crystal display, a gate driver supplying a scanning signal to the liquid crystal display, and a timing controller supplying the input data to the input line, and controlling the data driver and the gate driver.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

With reference to FIGS. 6 to 9, the present invention is explained as follows.

Figure 1:
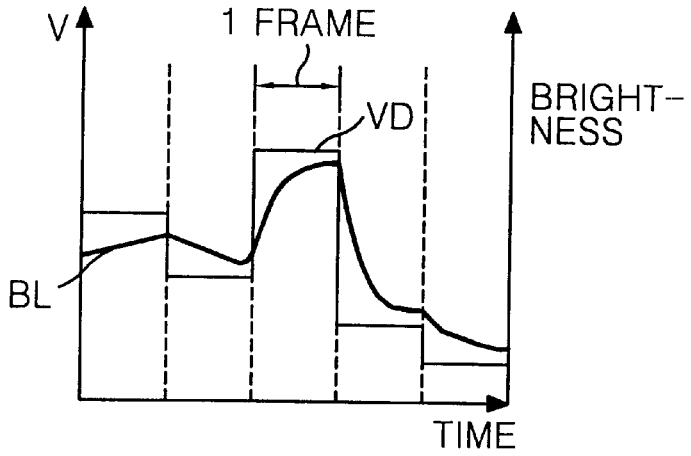
FIG. 1 CONVENTIONAL ART
FIG. 1 is a waveform diagram illustrating a brightness variation with respect to a data modulation in a conventional liquid crystal display.
Figure 2:
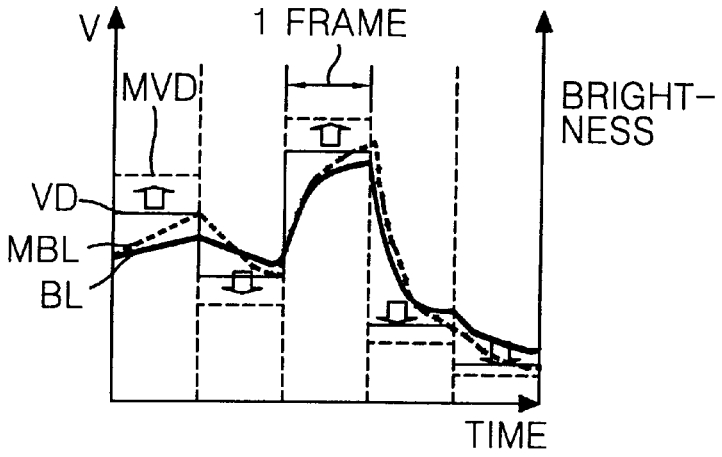
FIG. 2 CONVENTIONAL ART
FIG. 2 is a waveform diagram illustrating a brightness variation with respect to a data modulation in a conventional high-speed driving scheme.
Figure 3:
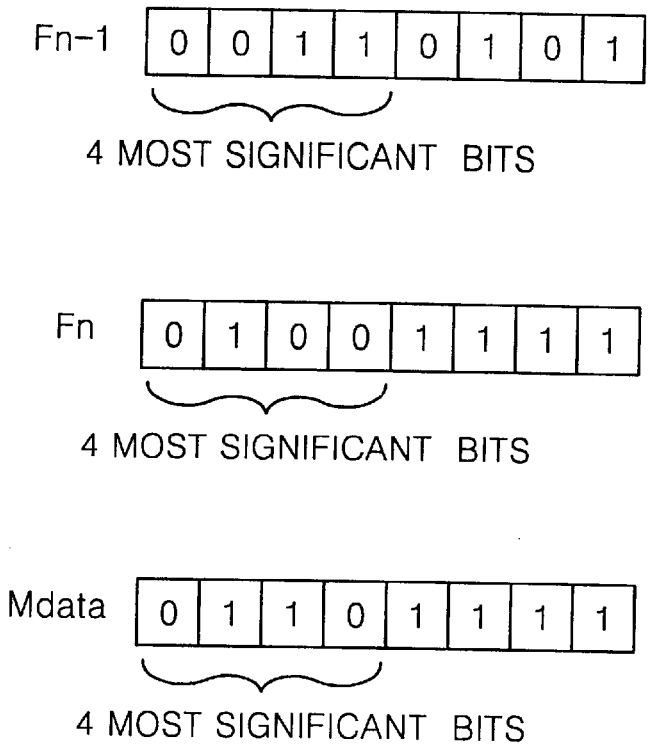
FIG.3 CONVENTIONAL ART
FIG. 3 is a schematic diagram illustrating the conventional high-speed driving scheme using 8 bit data.
Figure 4:
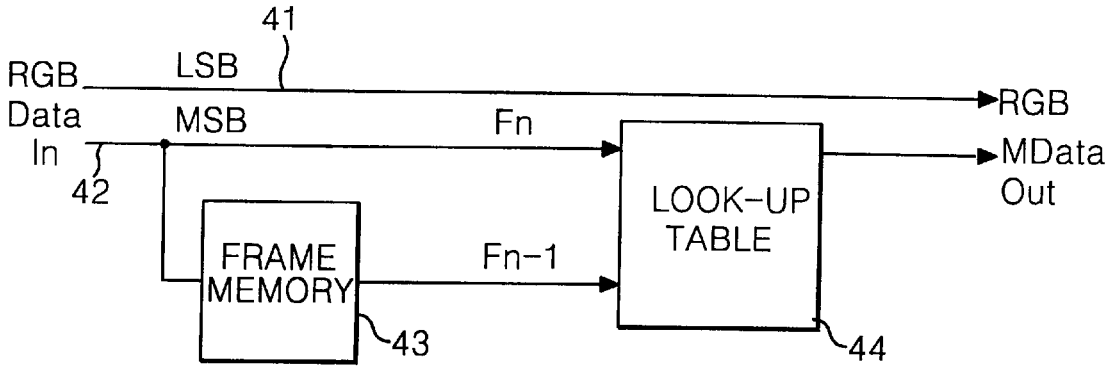
FIG.4 CONVENTIONAL ART
FIG. 4 is a block diagram illustrating a configuration of a conventional high-speed driving apparatus.
Figure 5:
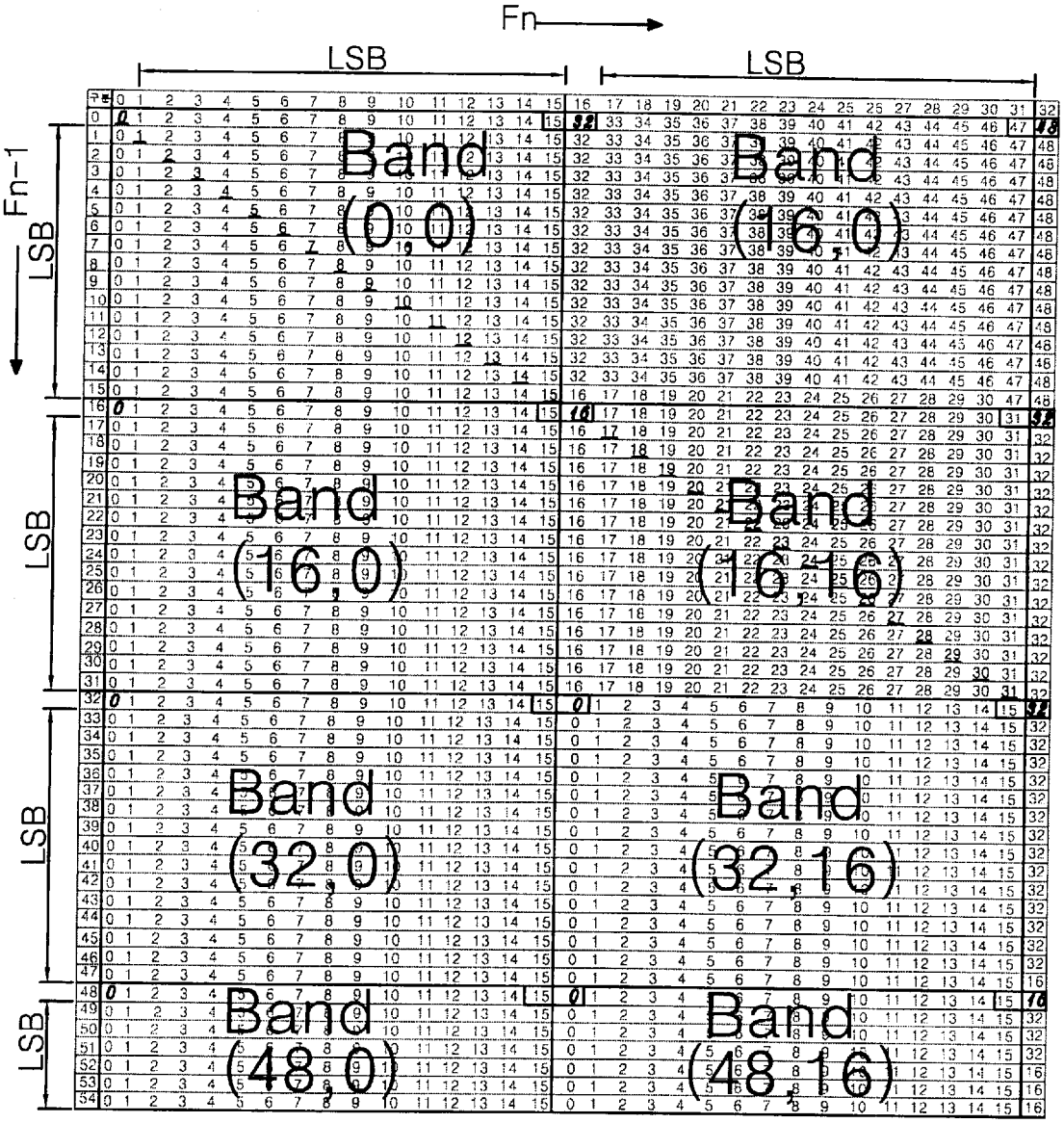
FIG.5 CONVENTIONAL ART
FIG. 5 represents a modulated data table into which modulated most significant bit data MSB and least significant bit data LSB are added in the conventional high-speed driving scheme.
Figure 6:
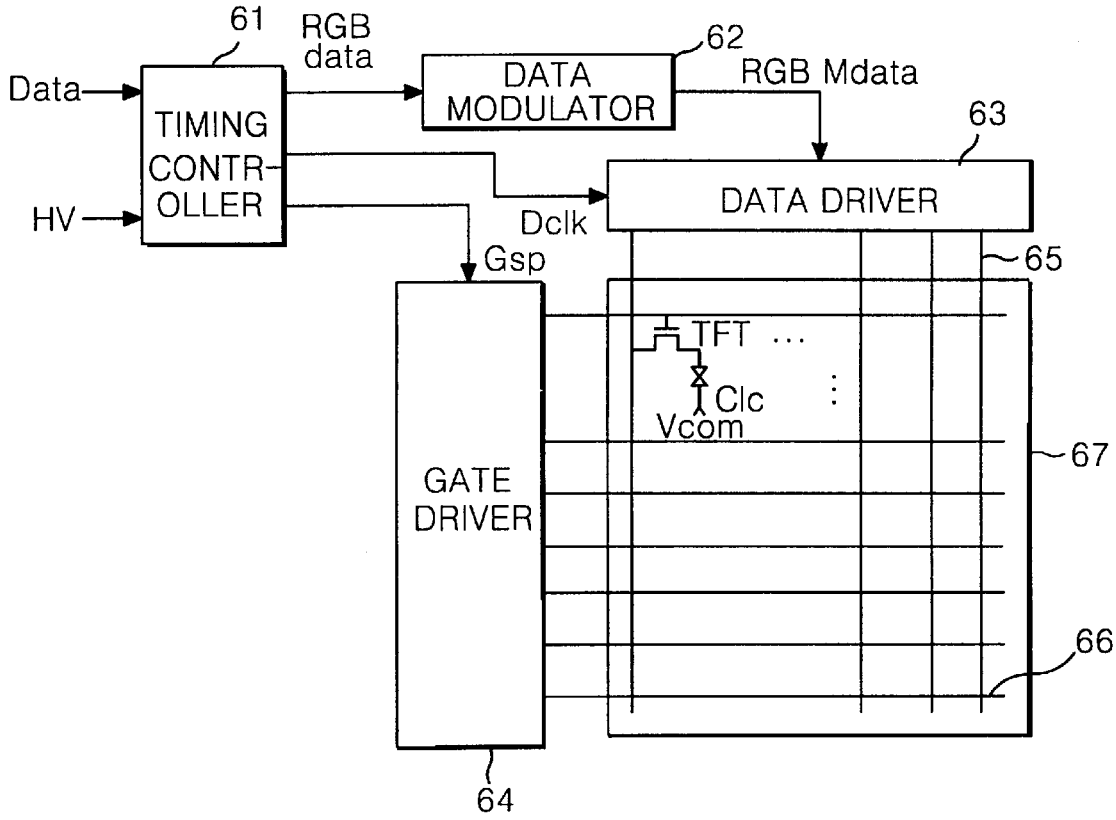
FIG. 6 is a block diagram illustrating a configuration of a driving apparatus for a liquid crystal display according to the present invention.

Initially, referring to FIG. 6, a driving apparatus for a liquid crystal display (LCD) according to the present invention includes a liquid crystal display panel 67 having a plurality of data lines 65 and gate lines 66 crossing each other and having thin film transistors (TFT's) provided at the intersections therebetween to drive liquid crystal cells Clc. A data driver 63 supplies modulated data to the data lines 65 of the liquid crystal display panel 67. A gate driver 64 applies a scanning pulse to the gate lines 66 of the liquid crystal display panel 67. A timing controller 61 receives digital video data and horizontal and vertical synchronizing signals H and V. A data modulator 62 is connected between the timing controller 61 and the data driver 63 to modulate an input data RGB.

More specifically, the liquid crystal display panel 67 has a liquid crystal between two glass substrates, and has the data lines 65 and the gate lines 66 provided on the lower glass substrate in such a manner to perpendicularly cross each other. The TFT provided at each intersection between the data lines 65 and the gate lines 66 responds to a scanning pulse so that the modulated input data on the data line 65 are supplied to the liquid crystal cell Clc. To this end, a gate electrode of the TFT is connected to the gate line 66 while a source electrode thereof is connected to the data line 65. A drain electrode of the TFT is connected to a pixel electrode of the liquid crystal cell Clc.

The timing controller 61 rearranges digital video data supplied from a digital video card (not shown). The RGB data rearranged by the timing controller 61 are supplied to the data modulator 62. Further, the timing controller 61 generates timing signals, such as a dot clock Dclk, a gate start pulse GSP, a gate shift clock GSC (not shown), an output enable/disable signal, and a polarity control signal using horizontal and vertical synchronizing signals H and V, thereby controlling the data driver 63 and the gate driver 64. The dot clock Dclk and the polarity control signal are applied to the data driver 63 while the gate start pulse GSP and the gate shift clock GSC are applied to the gate driver 64.

The gate driver 64 includes a shift register for sequentially generating a scanning pulse, that is, a gate high pulse in response to the gate start pulse GSP and the gate shift clock GSC applied from the timing controller 61, and a level shifter for shifting a voltage of the scanning pulse into a level suitable for driving the liquid crystal cell Clc. A TFT is turned on in response to the scanning pulse to apply video data on the data line 65 to the pixel electrode of the liquid crystal cell Clc.

The data driver 63 is supplied with red (R), green (G), and blue (B) modulated data RGB Mdata modulated by the data modulator 62 and receives the dot clock Dclk from the timing controller 61. The data driver 63 latches line by line, after sampling the red (R), green (G), and blue (B) modulated data RGB Mdata according to the dot clock Dclk and thereafter converts the latched data into analog data for applying to the data lines 65 every scanning period at the same time. Further, the data driver 63 may apply a gamma voltage corresponding to the modulated data to the data line 65.

The data modulator utilizes the look-up table according to a difference in compared RGB data between the previous frame Fn−1 and the current frame Fn, to modulate the current input RGB data. The data modulator 62 replaces the least significant bit data, which will be added with the modulated most significant bit data, with a desired value. Although, '0' may be the desired value, any values other than '0' may be selected as long as it prevents a sudden change of the modulated data value at the boundary between the adjacent bands where the modulated most significant bits become equal. The most significant bit data MSB modulated by the data modulator 62 may be selected to be high order bits of 4 bits or 3 bits. Hereafter, for a simplicity, it is assumed that the most significant bit data MSB are 4 bits.

Figure 7:
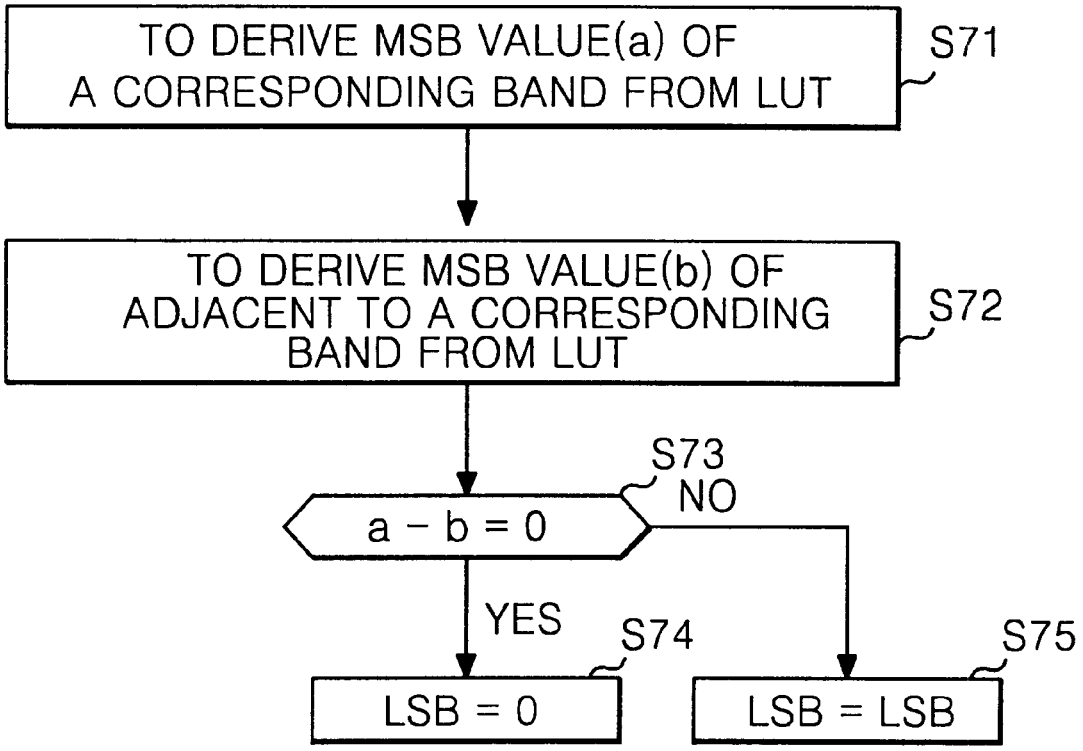
FIG. 7 is a flow chart illustrating a control procedure of a data modulator according to the present invention.

A modulation algorism of the data modulator 62 is illustrated in FIG. 7.

Referring to FIG. 7, the data modulator 62 reads the most significant bit values (a,b) from the band currently modulated at the look-up table and each of the adjacent bands (steps 71 and 72). Subsequently, the data modulator 62 calculates a difference between the most significant bit values (a,b) of the corresponding band modulated and the band adjacent thereto (step 73).

In step 73, if the most significant bit values (a,b) have no difference between the adjacent bands, that is, if the most significant bit data MSB (a,b) of the currently modulated band and the band adjacent thereto are equal (a−b=0), the least significant bit data LSB currently inputted is replaced with '0' (step 74).

In step 73, if the most significant bit values (a,b) have a difference (a−b≠0) between the adjacent bands, that is, if the most significant bit data MSB (a,b) of the currently modulated band and the band adjacent thereto are not equal, the value of the least significant bit data LSB currently inputted is not changed and is added with the most significant bit data (a) (step 75).

Figure 8:
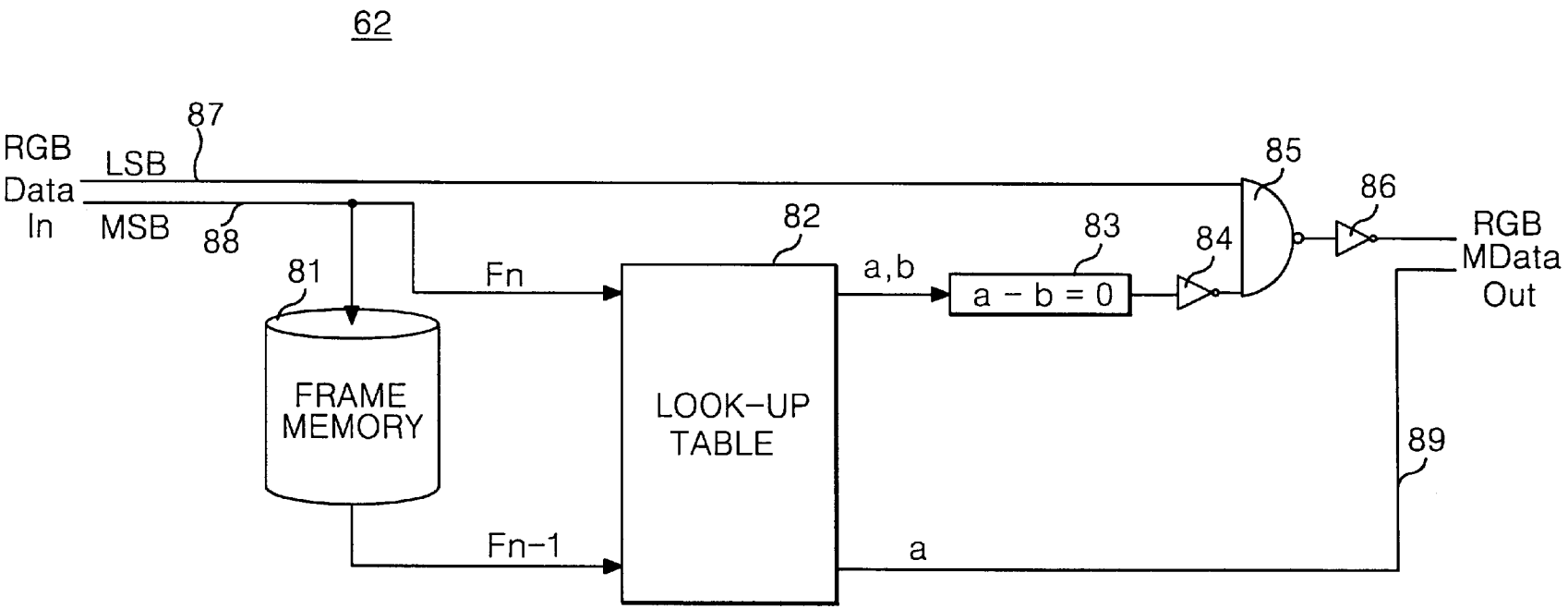
FIG. 8 is a detailed block diagram illustrating the data modulator in the FIG. 6.

The data modulator 62, implemented as in FIG. 8, modulates the data RGB data by using the above algorism.

Referring to the FIG. 8, the data modulator 62 according to the present invention includes a frame memory 81 to which most significant bit data MSB are inputted from the timing controller 61 (as shown in FIG. 6). A look-up table 82 modulates the most significant bit data. A comparator 85 compares the most significant bit values (a,b) between the band including the modulated data set in the look-up table 82 and the band adjacent thereto. A first inverter 84 inverses an output signal of the comparator 83. An NAND gate 85 executes an NAND operation on the output signal of the first inverter 84. A second inverter 86 inverses an output of the NAND gate 85.

More specifically, the frame memory 81 is connected to a most significant bit bus line 88 of the timing controller 61 to store the most significant bit data MSB inputted from the timing controller 61 during one frame interval. Further, the frame memory 81 supplies the stored most significant bit data MSB to the look-up table 82 every frame.

The look-up table 82 modulates the most significant bit data MSB of the current frame Fn, as given by the following equations ① to ③, in accordance with a difference between the most significant bit data MSB of the current frame Fn inputted from the most significant bit bus line 88 and the most significant bit data MSB of the previous frame Fn−1 inputted from of the frame memory 81.

$$VDn<VDn-1 \text{----}> MVDn<VDn \quad ①$$

$$VDn=VDn-1 \text{----}> MVDn=VDn \quad ②$$

$$VDn>VDn-1 \text{----}> MVDn>VDn \quad ③$$

In the above equations, VDn−1 represents a data voltage of the previous frame, VDn is a data voltage of the current frame, and MVDn represents a modulated data voltage. The look-up table 82 can be implemented as Table 1 and Table 2 in order to satisfy the conditions of these equations.

The look-up table 82 supplies modulated data value (a), which are included in the corresponding band and modulated in accordance with a difference in data between the previous frame Fn−1 and the current frame Fn, to a most significant bit output line 89. Thus, the look-up table 82 derives the most significant bit values (a,b) of the corresponding band and the band (the band in the right side) adjacent thereto, respectively, to supply to the comparator 83.

The comparator 83 calculates a difference of the most significant bit values (a,b) derived from the corresponding band modulated and the band adjacent thereto, respectively. If the difference value is '0', that is, if the most significant bit values (a,b) included in the adjacent bands are the same, it outputs a high logic '1'. Conversely, if the difference of the most significant bit values (a,b) included in the adjacent band is not '0', that is, if the most significant bit values (a,b) included in the adjacent band is different, it outputs a low logic '0'.

An NAND gate 85 executes an NAND operation on the least significant bit data LSB inputted from the least significant bit bus line 87 of the timing controller 61 and the output of the comparator 83 inversed by the first inverter 83 to supply the result value to the second inverter 86. By the NAND operation, if the output value of the first inverter 84 is a low logic '0', that is, if the most significant bit values (a,b) included in the adjacent bands are equal, the NAND gate 85 outputs a high logic '1' regardless of the least significant bit data LSB. Conversely, if the output value of the first inverter 84 is a high logic '1', that is, if the most significant bit values (a,b) included in the adjacent bands are different from each other, the value output from the NAND gate 85 becomes equal to the inversed least significant bit data LSB.

If the output signal of the NAND gate 85 is inversed by the second inverter 86, the least significant bit data LSB is replaced with '0' or the logical value remains the same, in accordance with a difference in data between the most significant bit values (a,b) included in the adjacent bands. If the most significant bit values (a,b) included in the adjacent bands are equal to each other, the least significant bit data output from the second inverter 86 becomes '0000'. On the contrary, if the most significant bit values (a,b) included in the adjacent bands are not equal to each other, the least significant bit data LSB output from the second inverter 86 becomes equal to the data on the least significant bit bus line 87.

Figure 9:
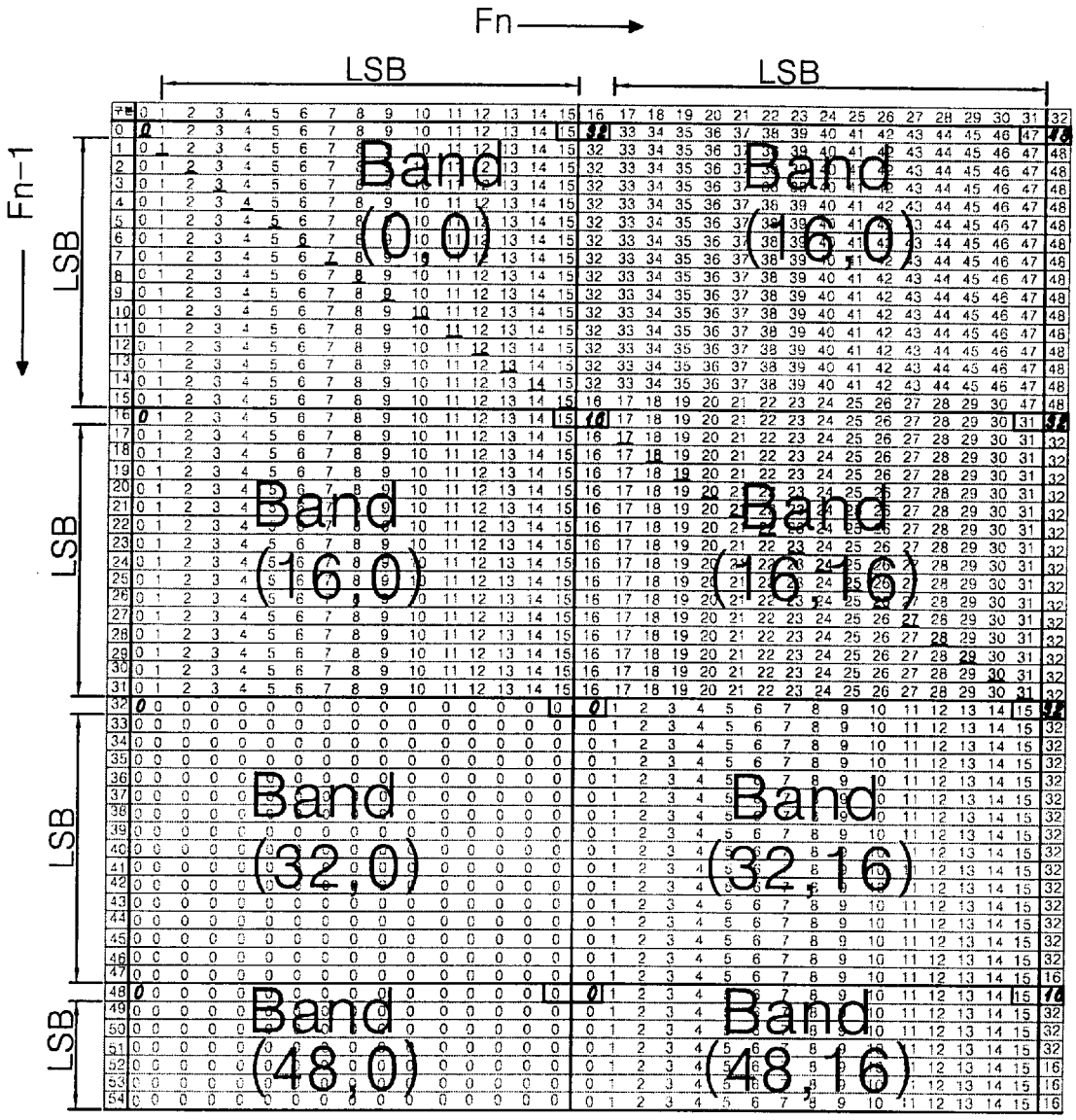
FIG. 9 represents a band of a look-up table in which least significant bit data are replaced with a desired value.

Therefore, if bands having the same most significant bit value are adjacent to each other, the corresponding band where the modulated data of the currently inputted data are included, is replaced with '0' regardless of the least significant bit data LSB. For example, both the band (32,0) and the band (48,0), in FIG. 9, are replaced with '0'. As a result, when the modulated data are changed from '32' to '15' and '32' to '16', because it changes from '32' to '0' and '32' to '0' respectively, a difference in the gray level is almost not recognizable to naked eyes in response to an actual difference in the gray level.

Thus, the bands having the least significant bit data replaced with '0' may be shown in the look-up table, as shown in Table 3.

TABLE 3

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

As shown in FIG. 9 and Table 3, the bands adjacent to the band in the right side, which has the same most significant bit value, shown in the shadowed cell, in the look-up table, have the least significant bit data LSB replaced with '0'.

As described above, according to the present invention, the method and apparatus of driving a liquid crystal display bypasses the significant bit data or replaces them with a certain value in accordance with a difference in data between the most significant bit value between the adjacent bands in the look-up table. As a result, even if there is almost no difference between the actual gray levels, an excessive brightness difference may not occur by using the high-speed driving scheme in the present invention. Consequently, a picture quality is improved because an image is displayed on the screen based on the actual gray level value.

In the present invention, the data modulator may be implemented by other means, such as a program and a microprocessor for carrying out this program, rather than the look-up table.

It will be apparent to those skilled in the art that various modifications and variations can be made in the method and apparatus for driving liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

dividing input data into most significant bit data and least significant bit data;

deriving a data value from modulated data registered in advance for modulating the most significant bit data;

determining whether adjacent modulated data are equal to each other; and replacing the least significant bit data with a desired value if the adjacent modulated data are equal to each other.

2. The method according to claim 1, further comprising:

maintaining the least significant bit data without a modulation if the adjacent modulated data are not equal to each other.

3. The method according to claim 1, further comprising:

adding the least significant bit data with most significant bit data which are modulated to the modulated data to input into a liquid crystal display.

4. The method according to claim 1, wherein the modulating the most significant bit data includes, determining modulated data in accordance with a difference in the input data between a previous frame and a current frame;

matching the modulated data with respect to each band in a look-up table; and searching the band in the look-up table corresponding to the most significant bit data, thereby modulating the most significant bit data using the modulated data of the searched band.

5. The method according to claim 1, wherein determining whether adjacent modulated data are equal to each other includes, deriving the modulated data from each modulated data of an adjacent band and a selected band corresponding to the most significant bit data; and determining whether the derived adjacent modulated data from each of the adjacent bands are equal.

6. A driving apparatus for a liquid crystal display, comprising:

a memory delaying most significant bit data of input data inputted from an input line;

a modulator modulating the most significant bit data from the input line and the delayed most significant bit data to select one modulated data among a plurality of modulated data registered in advance;

a comparator determining whether the adjacent modulated data are equal to each other; and a least significant bit converter replacing the least significant bit data with a desired value if the adjacent modulated data are equal to each other.

7. The driving apparatus according to claim 6, wherein the least significant bit converter maintains the inputted least significant bit data if the adjacent modulated data are not equal to each other.

8. The driving apparatus according to claim 6, further comprising:

a data driver supplying the modulated data and bypassed data to the liquid crystal display;

a gate driver supplying a scanning signal to the liquid crystal display; and a timing controller supplying the input data to the input line, and controlling the data driver and the gate driver.

9. The driving apparatus according to claim 6, wherein the most significant bit data and the least significant bit data are added and supplied to the data driver.

10. The driving apparatus according to claim 6, wherein the modulator includes a look-up table having the modulated data by bands in accordance with a difference in the input data between a previous frame and a current frame.

11. The driving apparatus according to claim 6, wherein the least significant bit converter includes, a first inverter inversing an output signal of the comparator;

an NAND gate performing an NAND operation on an output signal of the first inverter and least significant bit data from the input line; and a second inverter inversing an output signal of the NAND gate.

12. A liquid crystal display, comprising:

a liquid crystal display panel having a plurality of data lines and gate lines and displaying images;

a memory delaying most significant bit data of input data inputted from an input line;

a modulator modulating the most significant bit data from the input line and the delayed most significant bit data to select one modulated data among a plurality of modulated data registered in advance;

a comparator determining whether the adjacent modulated data are equal to each other;

a least significant bit converter replacing the least significant bit data with a desired value if the adjacent modulated data are equal to each other;

a data driver supplying the modulated data and bypassed data to the liquid crystal display;

a gate driver supplying a scanning signal to the liquid crystal display; and a timing controller supplying the input data to the input line, and controlling the data driver and the gate driver.

13. The liquid crystal display according to claim 12, wherein the most significant bit data and the least significant bit data are added and supplied to the data driver.

14. The liquid crystal display according to claim 12, wherein the modulator includes a look-up table having the modulated data by bands in accordance with a difference in the input data between a previous frame and a current frame.

15. The liquid crystal display according to claim 12, wherein the least significant bit converter includes, a first inverter inversing an output signal of the comparator;

an NAND gate performing an NAND operation on an output signal of the first inverter and least significant bit data from the input line; and a second inverter inversing an output signal of the NAND gate.

* * * * *